US008087406B2

(12) United States Patent
Axelsson

(10) Patent No.: US 8,087,406 B2
(45) Date of Patent: Jan. 3, 2012

(54) GUN USING COMPRESSED GAS TO PROPEL AN ARROW

(75) Inventor: Fredrik Axelsson, Hova (SE)

(73) Assignee: FX Airguns AB, Hova (SE)

( * ) Notice: Subject to any disclaimer, the term of this patent is extended or adjusted under 35 U.S.C. 154(b) by 0 days.

(21) Appl. No.: 12/970,258

(22) Filed: Dec. 16, 2010

(65) Prior Publication Data

US 2011/0146646 A1 Jun. 23, 2011

(30) Foreign Application Priority Data

Dec. 18, 2009 (EP) ..... 09179943

(51) Int. Cl.
*F41B 11/00* (2006.01)

(52) U.S. Cl. ..... 124/71

(58) Field of Classification Search ..... 124/71, 124/73, 74

See application file for complete search history.

(56) References Cited

U.S. PATENT DOCUMENTS 2,504,525 A * 4/1950 Holderness ..... 124/71
2,725,048 A * 11/1955 Koogle ..... 124/71
2,923,286 A 2/1960 Draganti
2,964,031 A 12/1960 Dotson
4,660,315 A 4/1987 Ferro
4,890,597 A * 1/1990 Ekstrom ..... 124/74
2004/0173197 A1* 9/2004 Moffitt ..... 124/74
2005/0183711 A1* 8/2005 Eichner et al. ..... 124/73
2005/0188979 A1* 9/2005 Berry ..... 124/76

OTHER PUBLICATIONS

European Search Report issued for European application No. EP09179943.7 to which the instant application claims priority; dated May 12, 2010, 4 pages.

* cited by examiner

*Primary Examiner* — Troy Chambers
(74) *Attorney, Agent, or Firm* — Harness, Dickey & Pierce, P.L.C.

(57) ABSTRACT

The present invention relates to a gun for using compressed gas to propel an arrow. The gun comprises a hollow barrel adapted to accommodate the arrow. The barrel has an open rear end and an open front end. The gun also includes a cylindrical chamber having a front end through which the barrel extends, a closed rear end, and a gas inlet for connecting the cylindrical chamber to a source of compressed gas. The cylindrical chamber is adapted to hermetically enclose the open rear end of the barrel and is axially movable between a non-firing position where the closed rear end of the cylindrical chamber sealingly engages the open rear end of the barrel, and a firing position where the closed rear end of the cylindrical chamber is displaced from the open rear end of the barrel to allow compressed gas to pass into the barrel via the open rear end of the barrel so as to propel the arrow out the open front end of the barrel. The gun has a simple and robust construction, and has a well-balanced behavior during use.

12 Claims, 4 Drawing Sheets

GUN USING COMPRESSED GAS TO PROPEL AN ARROW

CROSS-REFERENCE TO RELATED APPLICATION

Figure 1:
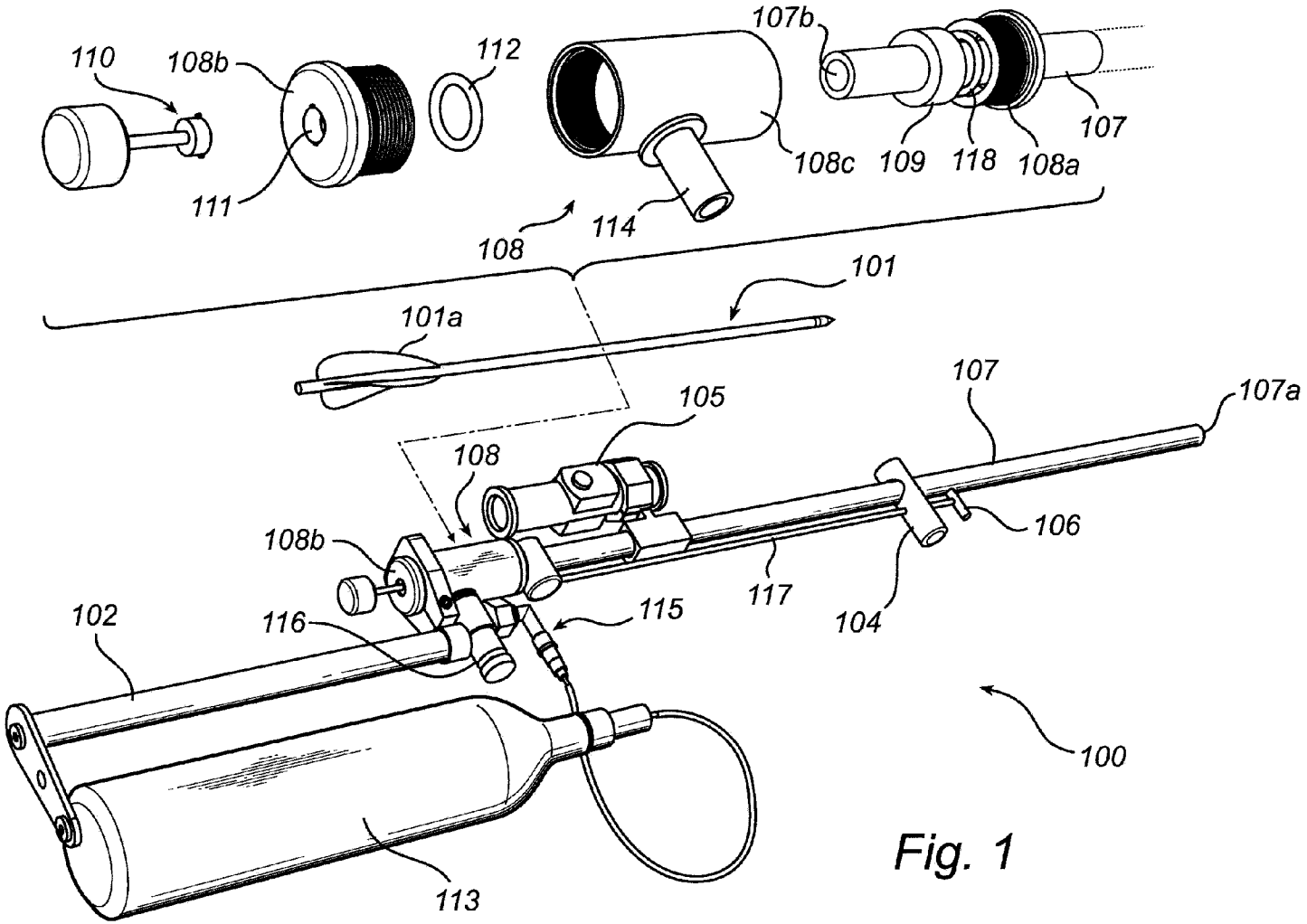

This application claims the benefit and priority of European patent application 09179943.7 filed Dec. 28, 2009. The entire disclosure of the above application is incorporated herein by reference.

TECHNICAL FIELD

The present invention relates to a gun using compressed gas to propel an arrow.

BACKGROUND

This section provides background information related to the present disclosure which is not necessarily prior art.

Guns using compressed gas as an energy source for propelling a projectile, such as an arrow, are well known in the art. The compressed gas may, for example, be compressed air or carbon dioxide supplied from a compressed gas source such as a tank or a gas cartridge. As the gun is fired the compressed gas is allowed to enter the barrel of the gun and propel the projectile.

An example of a gun for using compressed gas to propel an arrow is found in U.S. Pat. No. 4,660,315 disclosing a spear gun operated from the low pressure gas outlet of a diver's tank. The gun includes a first barrel over which a second barrel is slidably mounted. A gas inlet is mounted on the second barrel which in turn is normally forwardly positioned in a first non-firing position. Retraction of the second barrel acts as a slide valve to permit gas to enter the first barrel and force an arrow outwardly therefrom.

The gun disclosed in U.S. Pat. No. 4,660,315 and other guns adapted for use under water, typically do not provide a satisfactory shooting experience on land. Thus, the inventor hereof has recognized that there seems to be a need for an alternative gun for using compressed gas to propel an arrow.

SUMMARY

This section provides a general summary of the disclosure, and is not a comprehensive disclosure of its full scope or all of its features.

According to an aspect of the invention, there is provided a gun for using compressed gas to propel an arrow. The gun comprises a hollow barrel adapted to accommodate the arrow. The barrel has an open rear end and an open front end. The gun also comprises a cylindrical chamber having a front end through which the barrel extends, a closed rear end, and a gas inlet for connecting the cylindrical chamber to a source of compressed gas. The cylindrical chamber is adapted to hermetically enclose the open rear end of the barrel and is axially movable between a non-firing position where the closed rear end of the chamber sealingly engages the open rear end of the barrel, and a firing position where the closed rear end of the cylindrical chamber is displaced from the open rear end of the barrel to allow compressed gas to pass into the barrel via the open rear end of the barrel so as to propel the arrow out the open front end of the barrel.

This section provides a general summary of the disclosure, and is not a comprehensive disclosure of its full scope or all of its features.

Other objectives, features, and advantages will appear from the following detailed disclosure, from the claims as well as from the drawings.

DRAWINGS

The drawings described herein are for illustrative purposes only of selected embodiments and not all possible implementations, and are not intended to limit the scope of the present disclosure. The above, as well as additional features and advantages of the present invention, will be better understood through the following illustrative and non-limiting detailed description of preferred embodiments of the present invention, with reference to the appended drawings, where the same reference numerals will be used for similar elements.

Figure 2A:
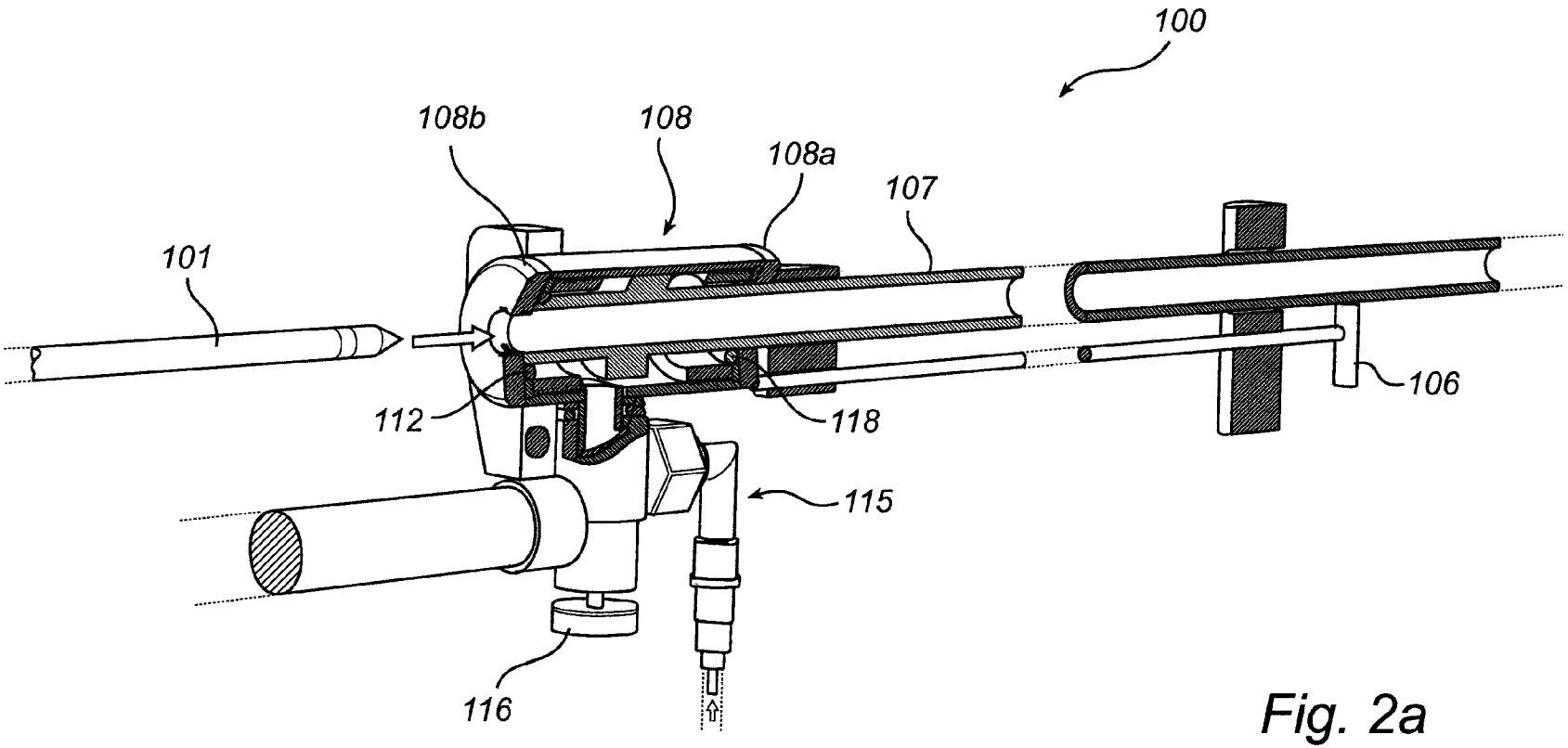
Figure 2B:
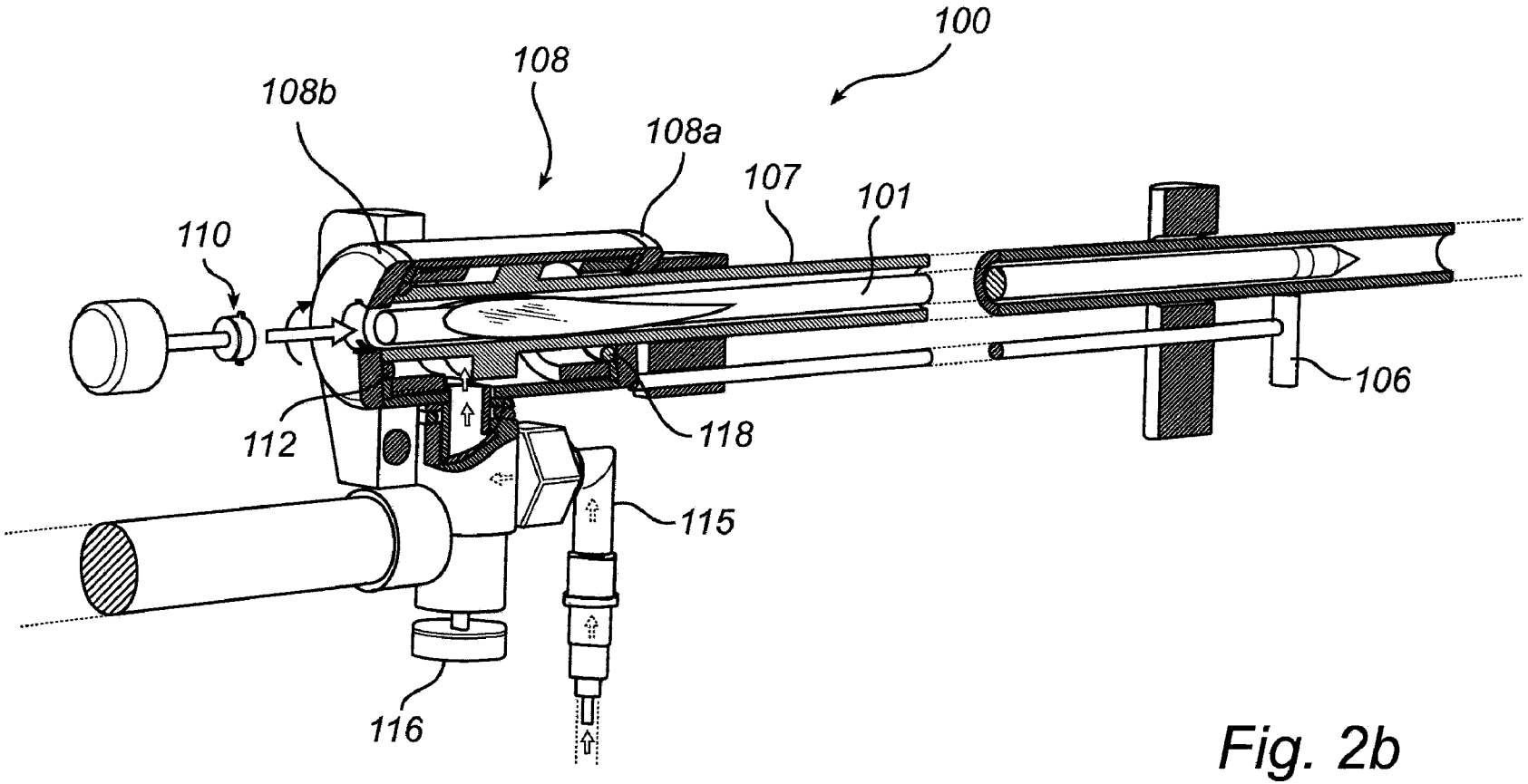
Figure 2C:
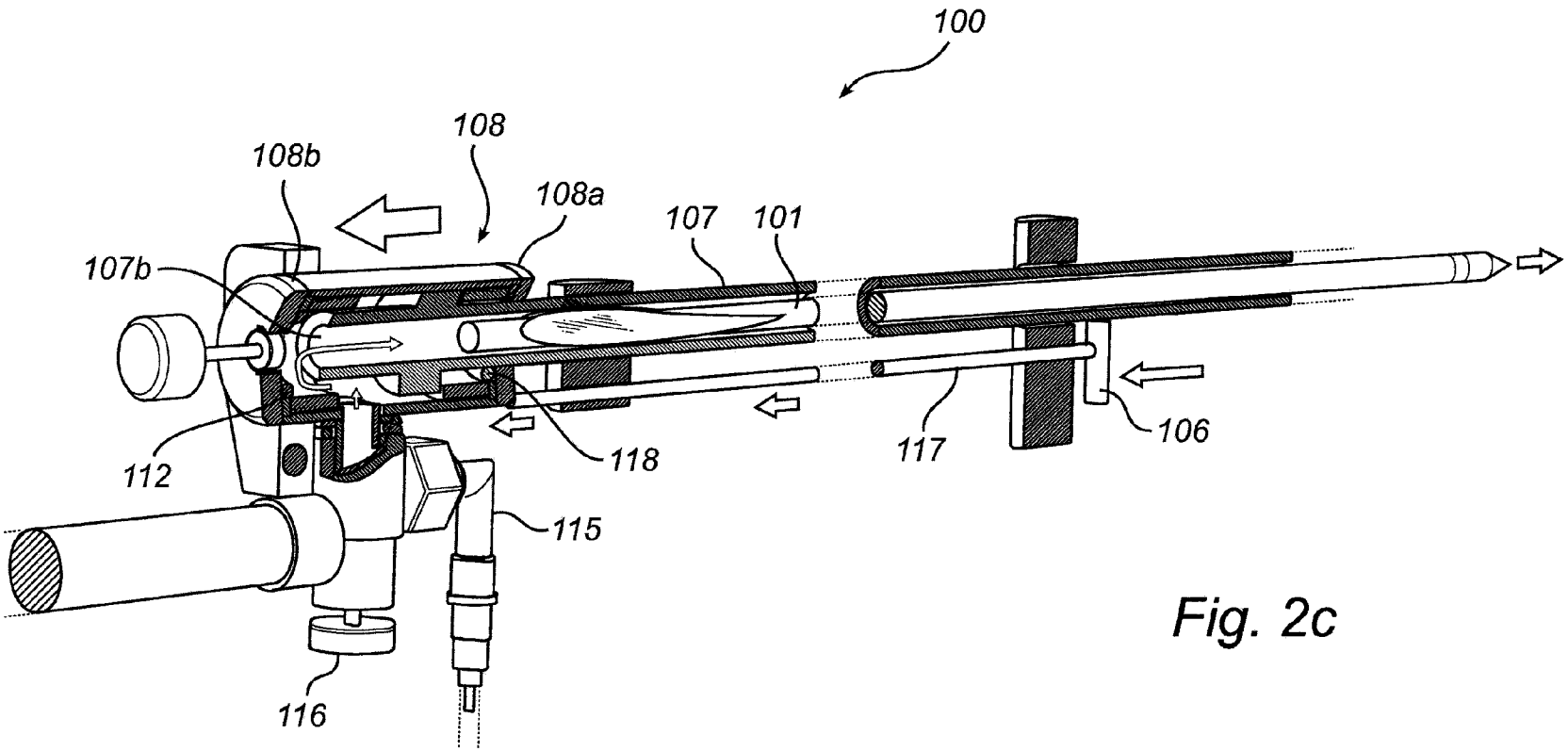

FIG. 1 is a perspective view schematically illustrating an embodiment of a gun according to the invention; and FIG. 2*a-c* schematically illustrates how an arrow is loaded and launched.

DETAILED DESCRIPTION

Example embodiments will now be described more fully with reference to the accompanying drawings.

The inventor hereof has disclosed herein an alternative gun for using compressed gas to propel an arrow, providing a satisfactory shooting experience. According to an aspect of the invention, there is provided a gun for using compressed gas to propel an arrow. The gun comprises a hollow barrel adapted to accommodate the arrow. The barrel has an open rear end and an open front end. The gun also comprises a cylindrical chamber having a front end through which the barrel extends, a closed rear end, and a gas inlet for connecting the cylindrical chamber to a source of compressed gas. The cylindrical chamber is adapted to hermetically enclose the open rear end of the barrel and is axially movable between a non-firing position where the closed rear end of the chamber sealingly engages the open rear end of the barrel, and a firing position where the closed rear end of the cylindrical chamber is displaced from the open rear end of the barrel to allow compressed gas to pass into the barrel via the open rear end of the barrel so as to propel the arrow out the open front end of the barrel.

The present invention is based on the understanding that by providing a cylindrical chamber which hermetically encloses the open rear end of the barrel and allowing a relative movement between the chamber and the barrel, the open rear end of the barrel may be sealed by the closed rear end of the cylindrical chamber in the non-firing position, whereas air may enter the barrel via the open rear end of the barrel in firing position. This leads to a simple and robust construction of the gun, and a more well-balanced behavior during use.

The barrel and the cylindrical chamber may preferably be coaxially arranged. The symmetry and balance of the gun may be further improved by using a cylindrical chamber with the shape of a right circular cylinder, i.e. the front end and the rear end of the cylindrical chamber have circular shapes. However, the front end and the rear end of the cylindrical chamber may also take other shapes such as e.g. a rectangular, a hexagon, or a non-circular ellipse.

The closed rear end of the chamber may preferably be provided with an openable breech which in open position provides access to the barrel. The openable breech allows the gun to be loaded via the open rear end of the barrel. Introducing the arrow into the barrel with the tip first is often more convenient and spares the fletching of the arrow.

The cylindrical chamber may be biased towards its non-firing position to prevent injuries due to accidental firing of the gun.

A portion of the barrel enclosed by the cylindrical chamber may preferably have a shape that causes compressed gas in the cylindrical chamber to urge the chamber into the non-firing position. This can be achieved by providing a barrel where the outside diameter of the barrel in the rear end is larger than the outside diameter near the front end of the chamber.

According to an alternative embodiment, a portion of the barrel enclosed by the chamber may be provided with an outside shoulder, wherein the bias is achieved by means of a resilient element arranged between the outside shoulder and the front end of the chamber. The resilient element may be a coil spring arranged around the barrel.

The openable breech may be attached to the chamber by means of a bayonet coupling. An advantage with a bayonet coupling is that the breech may be easily opened and closed, while also enabling a strong and robust closure of the cylindrical chamber that prevents accidental opening of the breech upon firing. Alternatively, the openable breech may be attached by a threaded connection, e.g. the breech may be a screw plug adapted to be screwed into an opening with internal threads provided in the closed rear end of the cylindrical chamber.

The gun may further comprise a trigger for urging the cylindrical chamber to the firing position.

The trigger may be arranged in front of the cylindrical chamber and interact with the cylindrical chamber by means of a shaft arranged to push back the cylindrical chamber as the trigger is pulled, thereby moving the cylindrical chamber into the firing position.

The closed rear end of the cylindrical chamber may be provided with a sealing member adapted to provide a hermetic seal between the open rear end of the barrel and the closed rear end the cylindrical chamber, when the chamber is in non-firing position. The sealing member may, for example, be an O-ring, wherein the inner diameter of the O-ring is adapted to fit tightly around the outer diameter of the barrel. An advantage with the arrangement is that as the cylindrical chamber is filled with compressed gas, the O-ring squeezes the open rear end of the barrel so that only intentional actuation of the trigger fires the gun.

With reference now to the Figures, FIG. 1 schematically illustrates an exemplary embodiment of a gun 100 for using compressed gas to propel an arrow 101. The gun is here a handheld gun with a shoulder piece 102, and a front handle 104 so that the gun may be held as a rifle. There is also a telescopic sight 105 for aiming, and a trigger 106 for firing the gun.

The gun has a hollow barrel 107 for accommodating the arrow 101. The hollow barrel has an open front end 107*a* and an open rear end 107*b*. As is recognized by a person skilled in the art, the inner diameter of the barrel (defined by an inner surface of the barrel) and the length of the barrel may vary due to the arrows that are to be used. However, the barrel is preferably sufficiently long to accommodate the complete length of the arrow. Here the barrel has an inner diameter of 10 millimeters (mm), an outer diameter of 14 mm, and a length of 500 mm.

The gun further comprises a cylindrical chamber 108 hermetically enclosing the open rear end 107*b* of the barrel. The cylindrical chamber preferably has the shape of a right circular cylinder, i.e. the cylindrical chamber has a circular front end 108*a* and a circular rear end 108*b*. The cylindrical chamber and the barrel are preferably coaxially arranged, as the symmetry about the common axis results in a well-balanced gun. The cylindrical chamber is constructed of a rigid material, such as e.g.

steel, to withstand the pressure associated with the compressed gas. The cylindrical chamber can e.g. be manufactured by fixing a screw plug 108*a,b* at either end of a tube 108*c*, or by welding a plate at either end of a steel tube.

A rear portion of the barrel extends through an opening in the front end 108*a* of the cylindrical chamber. The rear portion of the barrel is here provided with an outside shoulder 109 with a diameter being larger than the diameter of the opening in the front end of the cylindrical chamber, so that the rear portion of the barrel cannot be pulled out of the chamber. A sealing member 118, such as an O-ring, is preferably arranged at the opening in the front end of the chamber, wherein the inner diameter of the O-ring is adapted to fit tightly around the outer diameter of the barrel to prevent leakage of compressed gas. The chamber is typically dimensioned to be able to hold a volume of compressed gas enough to launch the arrow at a desired speed. Here, the inner diameter of the chamber is 30 mm, and the length of the chamber is 120 mm.

The closed rear end 108*b* of the chamber is provided with an openable breech 110 which in open position provides access to said barrel. The breech is here a plug 110 which is attached to an opening 111 in the closed rear end of the cylindrical chamber by a bayonet coupling.

The cylindrical chamber 108 is slidably mounted in relation to the barrel 107, and is thus movable, in the axial direction of the chamber, between a non-firing position where the closed rear end 108*b* of the cylindrical chamber sealingly engages the open rear end 107*b* of the barrel, and a firing position where the closed rear 108*b* end of the cylindrical chamber is displaced from the open rear end 107*b* of the barrel to create a passageway that allows compressed gas to enter the barrel via the open rear end 107*b* of the barrel so as to propel the arrow out the open front end 107*a* of the barrel.

The closed rear end 108*b* of the cylindrical chamber is preferably provided with a sealing member adapted 112 to provide a hermetic seal between the open rear end 107*b* of the barrel and the closed rear end 108*b* of the cylindrical chamber, when the chamber is in non-firing position. The sealing member is here a conventional O-ring 112, wherein the inner diameter of the O-ring is adapted to fit tightly around the outer diameter of the barrel. Thus, the inner diameter of the O-ring may preferably be slightly smaller than the outer diameter of the barrel in the rear end. Here the inner diameter of the O-ring is 13.8 mm. When the cylindrical chamber is filled with compressed gas, the O-ring is squeezed around the open rear end of the barrel so that only intentional actuation of the trigger fires the gun.

A compressed gas source 113 is connected to a gas inlet 114 in the cylindrical chamber via a coupling 115. The coupling may preferably be provided with a valve 116 that can be used turn on and off the supply of compressed gas. The compressed gas source is here a tank containing compressed air.

The trigger 106 is here arranged at the front handle 104 of the gun, and is thus arranged in front of the chamber 108. The trigger interacts with cylindrical chamber by means of a shaft 117 arranged between the trigger and the chamber to push back the chamber (in relation to the barrel) as the trigger is pulled.

The gun may be used to shoot arrow-like projectiles 101. The length of the arrow may vary depending on the application, but a typical arrow is between 150 mm and 700 mm long. Here the arrow has a length of 500 mm. The arrow is typically made from a rigid lightweight material such as e.g. fiber glass or aluminum. The arrow is preferably provided with a fletching 101*a* at a rear end of the arrow shaft. The fletching aids in the accuracy of the flight path of the arrow.

The arrow is loaded by opening the openable breech 110 and inserting the arrow into the barrel starting with the tip as best shown in FIG. 2*a*. As the arrow is loaded it is slightly rotated to bend the fletching. The fletching holds the arrow in place inside the barrel. The fletching also fills out the space between the arrow shaft and the inner surface of the barrel, and thus aids in the propelling of the arrow out of the barrel. After insertion of the arrow in the barrel, the breech 110 is closed as shown in FIG. 2*b*. The chamber 108 is now located in the non-firing position, i.e. the O-ring 112 at the rear end of the chamber sealingly engages the open rear end 107*b* of the barrel. The valve 116 at the gas inlet of the chamber is opened and the cylindrical chamber 108 is filled with compressed gas supplied by the compressed gas source 113. As the compressed gas in the chamber 108 has reached a desired pressure, the valve 116 is closed. The desired pressure may be regulated by a regulator arranged between the gas source 113 and the chamber 108. As an example, the desired pressure may be around 60 bar.

As the cylindrical chamber is filled with compressed gas, the O-rings 112, 118 at the closed rear end of the chamber and at the front end of the chamber squeezes the outside of the barrel so that only intentional actuation of the trigger fires the gun. The O-ring 112 at the rear end of cylindrical chamber also prevents compressed gas from entering the barrel.

As the trigger 106 is pulled the shaft 117 will push the chamber 108 backwards relative the barrel 107, as shown in FIG. 2*c*, such that the rear end 107*b* of the barrel is displaced from the O-ring 112, wherein compressed gas passes into the barrel via the open rear end 107*b* of the barrel and propels the arrow 101 out the open front end 107*a* of the barrel.

After firing, the chamber 108 can be pushed forward to non-firing position.

Optionally, a portion of the barrel located inside the chamber may have an outside diameter in the rear end which is larger than the outside diameter located near the front end of the chamber (when in non-firing position), whereby the pressure of compressed gas contained inside the chamber will press the chamber forward in relation to the barrel, thereby providing a bias towards the non-firing position so that only intentional actuation of the trigger fires the gun.

Optionally, the barrel may extend through a coil spring (not shown) arranged between the outside shoulder 109 on the barrel and the front end 108*a* of the chamber to continually press the closed rear end 108*b* of the chamber towards the open rear end 107*b* of the barrel. This leads to enhanced safety and an automatic return of the chamber 108 to the non-firing position after the arrow has been launched.

The breech opening may preferably have a diameter that essentially corresponds to the inner diameter of barrel. Thus, as the breech opening is slightly smaller than the outer diameter of the rear end of the barrel, the O-ring 112 arranged at the closed end of the chamber may remain sealingly engaged with the rear end 107*b* of the barrel also when the breech is open.

The invention has mainly been described above with reference to a few embodiments. However, as is readily appreciated by a person skilled in the art, other embodiments than the ones disclosed above are equally possible with the scope of the invention, as defined by the appended patent claims. For example, other gases than compressed air may be used such as e.g. CO2. Moreover, the invention is equally applicable to other types of guns for launching arrow-like projectiles, such as a pistol, or a stand-mounted launcher. The invention may for example find application in guns used for recreation, hunting, target-shooting, for tranquilizer guns, or for shooting a rope.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Disclosure of values and ranges of values for specific parameters are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A gun using compressed gas to propel an arrow, comprising:

a hollow barrel adapted to accommodate the arrow, said barrel having an open rear end and an open front end; and a cylindrical chamber having a front end through which the barrel extends, a closed rear end, and a gas inlet for connecting said cylindrical chamber to a source of compressed gas, wherein said cylindrical chamber is adapted to hermetically enclose the open rear end of said barrel and is axially movable between a non-firing position where said closed rear end of the cylindrical chamber sealingly engages the open rear end of the barrel, and a firing position where the closed rear end of said cylindrical chamber is displaced from the open rear end of the barrel to allow compressed gas to pass into said barrel via the open rear end of the barrel so as to propel the arrow out the open front end of said barrel.

2. A gun according to claim 1, wherein the closed rear end of the chamber is provided with an openable breech which in open position provides access to said barrel.

3. A gun according to claim 2, wherein the cylindrical chamber is biased towards its non-firing position.

4. A gun according to claim 3, wherein a portion of the barrel enclosed by said chamber is provided with an outside shoulder, wherein the bias is achieved by means of a resilient element arranged between said outside shoulder and the front end of said chamber.

5. A gun according to claim 3, wherein a portion of the barrel enclosed by said chamber has a shape that causes the compressed gas in said cylindrical chamber to urge the chamber into said non-firing position.

6. A gun according to claim 5, wherein a portion of the barrel enclosed by said chamber is provided with an outside shoulder, wherein the bias is achieved by means of a resilient element arranged between said outside shoulder and the front end of said chamber.

7. A gun according to claim 1, wherein the cylindrical chamber is biased towards its non-firing position.

8. A gun according to claim 7, wherein a portion of the barrel enclosed by said chamber is provided with an outside shoulder, wherein the bias is achieved by means of a resilient element arranged between said outside shoulder and the front end of said chamber.

9. A gun according to claim 1, wherein the openable breech is attached to the chamber by means of a bayonet coupling.

10. A gun according to claim 1, further comprising a trigger for urging said cylindrical chamber to said firing position.

11. A gun according to claim 10, wherein the trigger is arranged in front of the cylindrical chamber and interacts with the cylindrical chamber by means of a shaft arranged to push back the cylindrical chamber as the trigger is pulled, thereby moving the cylindrical chamber into said firing position.

12. A gun according to claim 1, wherein the closed rear end of the cylindrical chamber is provided with a sealing member adapted to provide a hermetic seal between the open rear end of the barrel and the closed rear end of said cylindrical chamber, when said chamber is in non-firing position.

* * * * *